US005249747A

United States Patent [19]

Hanson et al.

[11] Patent Number: 5,249,747

[45] Date of Patent: * Oct. 5, 1993

[54] SPRAYABLE DISPENSING SYSTEM FOR VISCOUS VEGETABLE OILS AND APPARATUS THEREFOR

[75] Inventors: Wayne H. Hanson, La Quinton, Calif.; Robert Smith, Ballwin, Mo.

[73] Assignee: Par-Way Group, Costa Mesa, Calif.

[ * ] Notice: The portion of the term of this patent subsequent to Feb. 18, 2009 has been disclaimed.

[21] Appl. No.: 832,013

[22] Filed: Feb. 6, 1992

Related U.S. Application Data

[63] Continuation-in-part of Ser. No. 553,786, Jul. 12, 1990, Pat. No. 5,088,649.

[51] Int. Cl.[5] ..... B05B 1/26

[52] U.S. Cl. ..... 239/373; 239/544

[58] Field of Search ..... 239/543–545, 239/324, 331, 333, 373, 433, 520

[56] References Cited

U.S. PATENT DOCUMENTS 3,568,933 3/1971 Maguire-Cooper ..... 239/543
5,088,649 2/1992 Hanson et al. ..... 239/324

FOREIGN PATENT DOCUMENTS 237207 9/1987 European Pat. Off. ..... 239/708
2495022 6/1982 France .
2153444A 1/1984 United Kingdom .

*Primary Examiner*—Andres Kashnikow
*Assistant Examiner*—Kevin P. Weldon
*Attorney, Agent, or Firm*—James A. Quinton; Frank Frisenda, Jr.

[57] ABSTRACT

A closed pressurized spray container is provided. The container includes a nozzle assembly interconnected with the delivery passageway or conduit from the self contained closed pressurized container. The nozzle assembly has a first and second passageway, preferably conduits which are connected to a mechanical break up chamber which is connected to the delivery passageway or conduit of the pressurized container. The first and second passageways split and splits the fluid preferably a pan coating exiting from the mechanical break up chamber into two streams. Each conduit has a fluid outlet to the atmosphere. The first and second conduits in combination with said fluid outlets define a discharge axis. The first fluid conduit discharge axis intersects the second fluid discharge axis at an impingement angle $\beta$ of from 10° to 170° so that the pan coating exiting each outlet intersects at a point exterior to the nozzle. As a result the fluid exiting the first outlet collides with the pan coating exiting from the second outlet to break the pan coating into small droplets to form a wide angle mist for application to a surface.

50 Claims, 3 Drawing Sheets

SPRAYABLE DISPENSING SYSTEM FOR VISCOUS VEGETABLE OILS AND APPARATUS THEREFOR

This is a Continuation-in-Part of co-pendent patent application Ser. No. 553,786 filed Jul. 12, 1990 now U.S. Pat. No. 5,088,699.

FIELD OF THE INVENTION

The field of the invention is viscous vegetable oil based compositions and in particular a dispensing system for viscous vegetable oil containing products such as pan coatings and an apparatus relating thereto.

DESCRIPTION OF THE PRIOR ART

Vegetable oils are widely used in cooking. Lecithin has been recognized as an advantageous cooking lubricant and release agent. Commonly lecithin is combined with vegetable oil to provide an edible pan release agent. However, there have been difficulties encountered in providing a readily sprayable pan release agent. Vegetable oil containing compositions have rather high viscosity which results in special problems in providing an aerosol container which will effectively deliver the oil as fine mist For example, a 90% vegetable oil (soybean oil) mixed with 10% lecithin would have an approximate viscosity at 66° F. of 87 cps.

Considerable efforts have been made to provide spray dispensable lecithin, vegetable oil compositions Aerosol compositions have been provided in the prior art. Many of such compositions employ the use of chlorofluoro hydrocarbon propellant or other hydrocarbon propellants which dissolve in the pressurized can to reduce the viscosity of the oil to allow an aerosol dispensible product at a reasonable pressure. For example, U.S. Pat. No. 3,896,975 (Follmer) shows such an aerosol composition and U.S. Pat. No. 4,188,412 (Sejpal).

Considering the possible harmful effects of chlorofluoro hydrocarbons on the ozone layer, it is now desirable to avoid their uses in food products Efforts to eliminate the use of the chlorofluoro hydrocarbons have resulted in the substitution of such propellants with isobutane or propane or other hydrocarbon propellants. It has been found to have a sprayable composition in such a form, it is necessary to dilute the composition with a solvent such as ethyl alcohol or water. See for example, U.S. Pat. No. 4,188,412 (Sejpal). However, substitution of the chlorofluoro hydrocarbons with other hydrocarbons and the use of an ethyl alcohol solvent still results in the use of volatile hydrocarbons which can have adverse environmental effects and may be flammable Ethyl alcohol is considered a volatile organic compound (VOC). It is environmentally desirable to remove VOC from products used by the consumer because VOC is a component of smog. Thus, it would be desirable to remove the hydrocarbon propellants and alcohol solvents altogether from pan coating and other viscous vegetable oil products.

Nozzle devices for pressurized containers have been proposed where the fluid exits the nozzle from two outlets. The exits for the outlets are on skew lines such that the output of the orifices meets tangentially outside the nozzle. The resulting turbulence is said to effect the breakup of the particles or agglomerates of liquids or solids in the propelling gas stream. See U.S. Pat. No. 3,406,913 (Frangos). Spray nozzles for fuel burners and water jets having converging jet passages outside the nozzle head are also shown in the prior art. See U.S. Pat. No. 1,055,789 (papa-Fedoroff), U.S. Pat. No. 2,785,926 (Latase). Spray nozzles having converging jet-forming passages inside the nozzle head have also been proposed U.S. Pat. No. 3,568,933 (Macguire).

SUMMARY OF THE INVENTION

The present invention is directed to an improved viscous vegetable oil containing dispensing system. The invention also relates to a method and apparatus for dispensing viscous vegetable oil containing compositions in closed pressurized containers such as aerosol containers or bladder packs. See for example U.S. Pat. No. 4,510,734 without having to use hydrocarbon propellants or to diluting the product with ethyl alcohol or other VOC pollutants.

It is an object of the invention to provide a viscous vegetable oil dispensing system which can dispense viscous vegetable oil containing products such as pan coatings having viscosity above 60 cps preferably about 65 cps without the need to dilute the product with VOC solvents such as ethanol.

It is another object of the invention to provide a pan coatings dispensing system that is water free.

It is an object of the invention to provide a viscous vegetable oil dispensing system that is free of chlorofluoro hydrocarbon and other hydrocarbon propellants.

It is an object of the invention to provide aerosol packaged vegetable oil-lecithin compositions which use a compressed gas as the propellant.

It is a further object of the invention to provide a closed pressurized dispensing system which can readily spray viscous products having a viscosity over 60 cps viscosity at pressurization levels of 140 psi at 130° F. or less in fine droplets.

It is another object of the invention to provide a closed pressurized system which can spray viscous liquids as fine droplets at a system pressure of 140 psi at 130° F. or less.

It is another object of the invention to provide an aerosol packaged vegetable oil-lecithin composition without the use of a liquid propellant.

Other, further objects will become apparent from the Specifications, Drawings and Claims.

According to the invention a closed, pressurized dispensing system for spraying viscous vegetable oil compositions preferably a lecithin containing pan coating is provided which can operate at normal pressurization levels of 140 psi or less at 130° F. Desirably the product contains a lecithin, vegetable oil mixture having from 1 to 15% lecithin and 99 to 85% vegetable oil.

A nozzle assembly is interconnected with the delivery passageway or conduit from the pressurized container such as a typical aerosol container. The nozzle assembly has a break up chamber which leads to a first and second passageway, preferably conduits which split the fluid preferably a viscous vegetable oil composition exiting from the break up chamber into two streams The cross sectional flow area of the first and second conduit means is smaller than the cross sectional flow area of the break up chamber so that the velocity of the viscous vegetable oil increases upon entry into the first and second conduits located in the nozzle assembly Each conduit has a fluid outlet to the atmosphere which directs the fluid from the first and second passageway to the atmosphere. The first and second conduits in combination with said fluid outlets define a discharge axis. The first fluid conduit discharge axis intersects the second fluid discharge axis at an impingement angle $\beta$ of from 10° to 170° preferably from 40° to 140° so that the pan coating exiting each outlet intersects at a point exterior to the nozzle. As a result the vegetable oil exiting the first outlet collides with the vegetable oil exiting from the second outlet to break the vegetable oil into small droplets to form a wide angle mist for application to a cooking surface. The impingement angle should be sufficiently high so that there is sufficient collision of the streams to form fine drops while at the same time preserving a sufficient forward velocity so that the vegetable oil can be sprayed on a cooking surface between 6 inches and 24 inches from the nozzle.

Desirably, the reduction in the cross sectional area between the break up chamber and the fluid outlets is about ½ to 1/200 of the cross sectional area of the break up chamber. Preferably this reduction is from ¼ to 1/100 and desirably about 1/50.

According to another aspect of the invention, a third and fourth passageway preferably conduits are provided which are located in the nozzle assembly. The third and fourth conduits are connected to the first and second conduits intermediate the first and second conduits and the first and second fluid outlets The third and fourth conduits have a smaller cross sectional flow area than does the first and second conduits so that the velocity of the vegetable oil preferably a pan coating travelling from the first and second conduit into the third and fourth conduit increases. According to this embodiment prior to reaching the fluid outlets, the velocity of the vegetable oil is increased from the break up chamber two times, once in the discharge to the first and second conduit, from the break up chamber and a second time from the discharge from the first and second conduit to the smaller third and fourth conduits The resulting vegetable oil dispensing system can dispense viscous vegetable oil having viscosity above 60 cps or above 170 saybolt viscosity in fine droplets to provide improved spray coverage for the cooking surface.

In another aspect of the invention, a closed pressurized fluid delivery container is provided which is particularly useful for the spraying of viscous fluids, particularly those having a viscosity of greater than 60 cps and most preferably about 65 cps. The pressurized containers is typically an aerosol can or other closed pressured container which can be held and sprayed by consumer with one hand.

In a further aspect of the invention, an aerosol packaged viscous vegetable oil composition is provided wherein the propellant is a non-hydrocarbon compressed gas such as nitrogen, air, nitrous oxide, carbon dioxide or argon.

In still a further aspect of the invention, a nozzle assembly for introduction into a closed pressurized container such as an aerosol container, as described above is provided The nozzle assembly according to the present invention is also useful in a hand pump spray dispenser.

The preferred embodiment of the present invention is illustrated in the drawings and examples. However, it should be expressly understood that the present invention should not be limited solely to the illustrative embodiment.

DETAILED DESCRIPTION OF THE INVENTION

Figure 1:
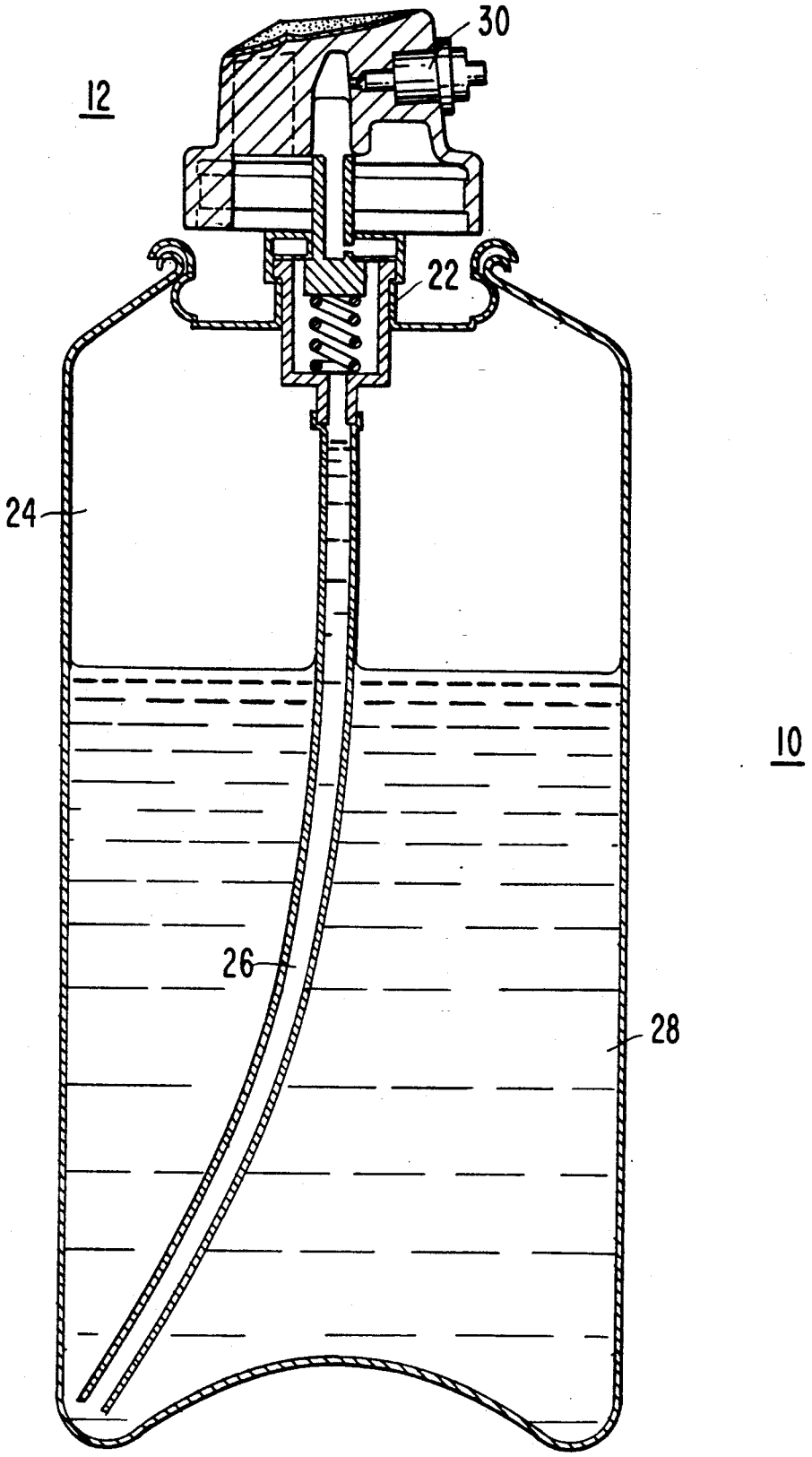
FIG. 1 is a perspective view of closed self contained pressurized container in accordance with the invention.

The present invention is directed to an improved vegetable oil dispensing system for dispensing viscous vegetable oil product without the use of hydrocarbon propellants or VOC solvents such as ethanol and without the use of other solvents or diluents such as water. According to the invention, a dispensing system for viscous pan coatings having a viscosity above 60 cps preferably from 65 cps to 100 cps most preferably from 70 to 85 cps is provided. In another aspect of the invention a closed pressurized container for spraying viscous liquids is provided In a still further aspect of the invention a spray nozzle is provided.

A viscous vegetable oil such as a pan coating, preferably a vegetable oil, lecithin mixture of 1 to 15% lecithin and 99 to 85% vegetable oil is placed in a closed pressurized container. A standard aerosol can or other closed pressurized container that can be held and sprayed by one hand operation by the consumer is provided for delivering the pan coating under pressure from the container to a delivery passageway or conduit. A bladder pack container as generally disclosed in U.S. Pat. No. 4,510,734 which is herein incorporated by reference, is also a useful closed pressurized container according to the invention. An alternative bladder pack is provided under the trademark AMOS by EXXEL container, Inc., Somerset, N.J.

A nozzle assembly is interconnected with the delivery passageway from the aerosol can or other container through a mechanical break up chamber located within the nozzle assembly. Included within the nozzle assembly is a first and second passageway preferably conduits which are connected to the mechanical break up chamber to split the pan coating exiting from the mechanical break up chamber into two streams. The cross sectional flow area of the first and second conduits is smaller than the cross sectional flow area of the mechanical break up chamber. As a result the velocity of the flowing fluid is speeded up as it travels from the mechanical break up chamber through the first and second conduits.

According to the invention the cross sectional area of the flow path of the viscous vegetable oil decreases as it passes from the mechanical break up chamber to first and second passageway. Preferably the sum of the cross sectional area of the first and second passageway is between 1/200 (0.005) and ½ (0.5) of that of the mechanical break up chamber and preferably between 1/100 (0.01) and ¼ (0.25) of the cross sectional area of the mechanical break up chamber and most preferably about 1/50 (0.02) the cross sectional area of the mechanical break up chamber.

The first and second conduits have a fluid outlet to the atmosphere. Each fluid outlet has a discharge axis such that the viscous vegetable oil exiting the first fluid outlet intersects the viscous vegetable oil exiting the second fluid outlet at a point exterior to the nozzle assembly. As a result the vegetable oil exiting from the first outlet collides with the vegetable oil exiting from the second outlet to break the vegetable oil into small droplets and to form a wide angle spray of fine droplets preferably generally rectangular in nature for application to a cooking surface.

Referring now to the drawings, FIG. 1 is a perspective representation of an aerosol type, closed, self-contained pressurized container according to the subject invention According to the invention, a closed self contained pressurized container such as an aerosol can 10 or optionally a bladder pack type container is provided.

According to the invention the aerosol container 10 is equipped with nozzle assembly 30. The aerosol can 10 includes an actuator 12 which when pressed down moves the valve stem 20 thereby opening the valve 22 to deliver pressurized product through dip tube 26 from concentrate reservoir 28. The pressurized fluid flows through valve 22 through valve stem 20 into actuator entrance conduit 14 and then through delivery conduit 18 which is in direct fluid communication with mechanical break chamber 32 of nozzle assembly 30.

Figure 2:
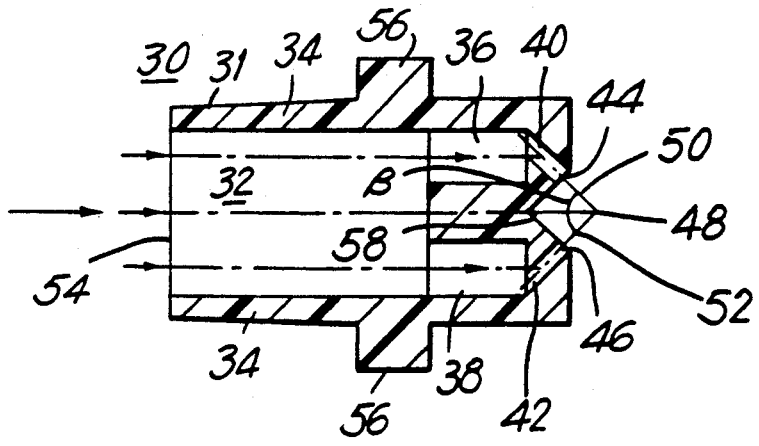
FIG. 2 is a section of the nozzle assembly for use in the invention looking down from the top.
Figure 3:
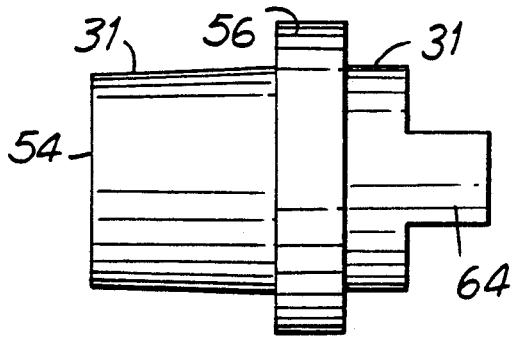
FIG. 3 is a sideview of the nozzle assembly for use in the invention.
Figure 4:
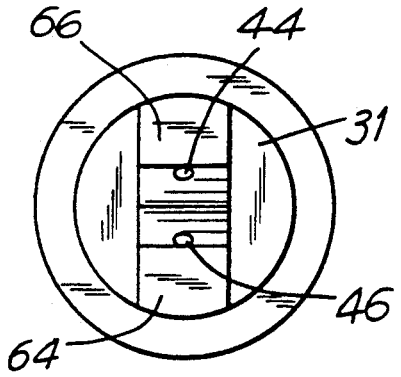
FIG. 4 is a front view of the nozzle assembly of the present invention.
Figure 5:
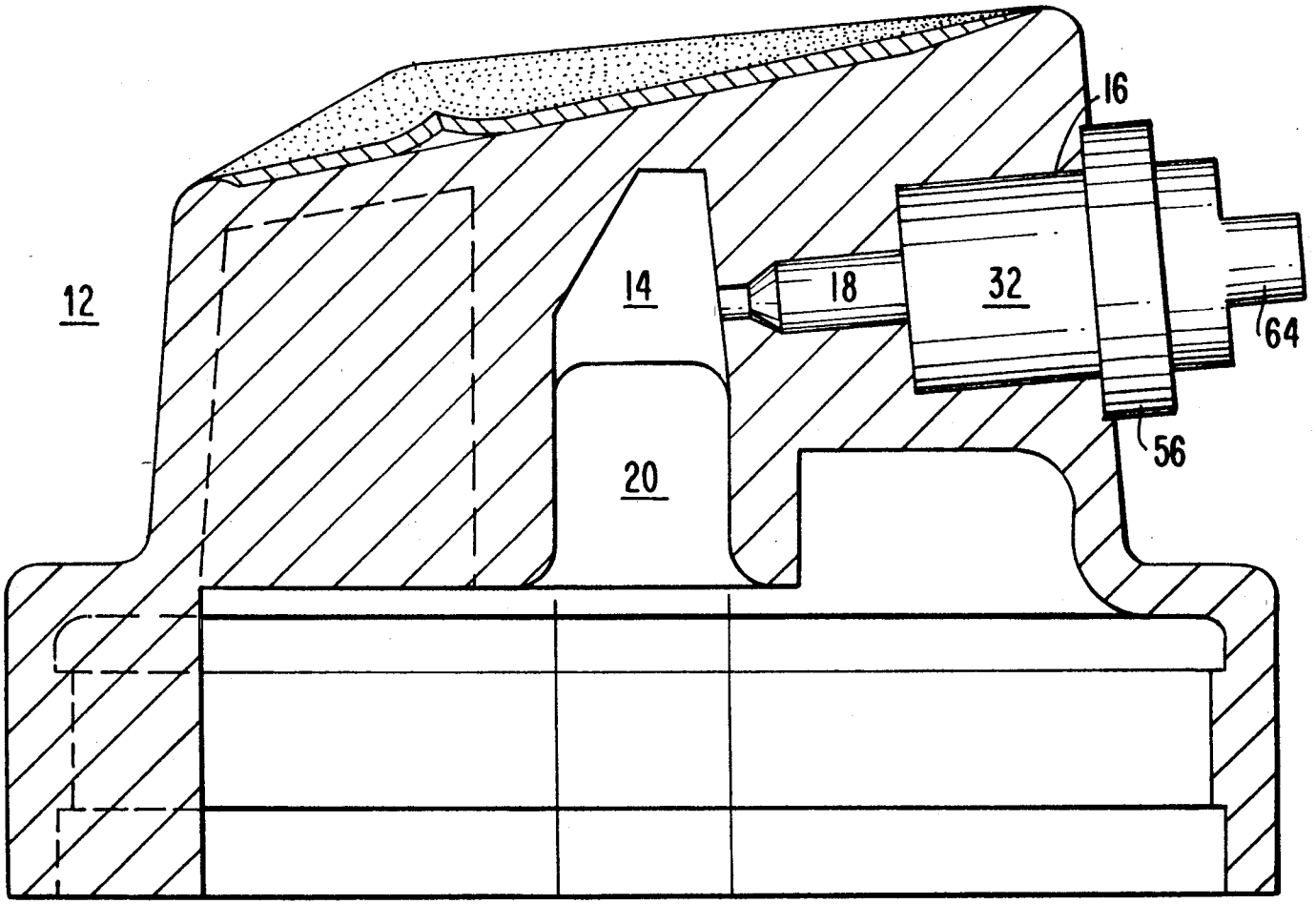
FIG. 5 is a sectional view of the nozzle assembly of FIG. 1 installed in an aerosol can.

Referring to FIGS. 1, 2 and 5, and as best seen in FIG. 2, a nozzle assembly 30 having a fluid inlet 54 and fluid outlets 44 and 46 is inserted within insert cavity 16 of actuator 12 for receipt of pressured fluid preferably a viscous vegetable oil e.g., a pan coating flowing in delivery conduit 18 upon the pressing of actuator 12 to activate valve 22. Nozzle assembly 30 has a generally tubular body 31 and snugly slips into insert cavity 16. Preferably integral with the nozzle assembly 30, an annular collar 56, located between inlet 54 and outlets 44 and 46, is provided to engage the side wall of actuator 12 to prevent the nozzle assembly 30 from travelling too far into insert cavity 16. Nozzle assembly 30 includes at its outlet end, projections 64 and 66 preferably twin projections which are separated by v-shaped notch 58. Outlets 44 and 46 are located at the top of the slanting side wall of v-shaped notch 58.

The nozzle assembly 30 has a break up chamber 32 which is connected to the delivery conduit 18. The break up chamber 32 can optionally be funnel shaped. A first fluid conduit 36 and a second fluid conduit 38 are provided to split the viscous fluid flowing through break up chamber 32 into two flowing paths. The cross sectional area of the first and second conduits 36 and 38 are smaller than the cross sectional area of break up chamber 32. Preferably the conduits 36 and 38 are twins that is, each is the same size and the same cross sectional area and ar located in the same location on the left and right side of break up chamber 32. Desirably the sum of the cross sectional areas of conduits 36 and 38 is about 0.25 that of channel 32.

A third conduit 40 and a fourth conduit 42 are provided at the end of conduits 36 and 38 to receive the speeded up viscous fluid flowing therein. Channels 40 and 42 have a cross sectional area smaller than that of channels 36 and 38. Preferably third conduit 40 and fourth conduit 42 are mirror images of one another. Preferably third conduit 40 is located in the same relative position to first conduit 36 as is fourth conduit 42 to second conduit 38 Most preferably third conduit 40 and fourth conduit 42 and both the same size and have the same cross sectional area. Desirably channels 40 and 42 have a cross sectional area which is about one-twelfth the cross sectional area of the first conduit 36 and second conduit 38. As a result, the velocity of the viscous fluid traveling through third conduit 40 and fourth conduit 42, increases. Optionally three or more passageways and outlets may be substituted for the two passageways shown to split the fluid into multiple paths. The discharge axises for the three or more passageways should then intersect as do the two passageways shown herein so that the exiting fluid paths collide.

Alternatively the aerosol container can be replaced by a bladder pack container such a that of the ATMOS bladder pack which is a product of EXXEL, Inc., Somerset, N.J. In such an embodiment, the nozzle assembly is connected to the delivery conduit from the bladder pack.

In the aerosol can of FIG. 1, a propellant is placed in the aerosol container and occupies head space 24. The propellant may be any suitable aerosol propellant. For food applications, the propellant should be a food grade propellant. In order to avoid the problems associated with hydrocarbon propellants, e.g., ozone depletion or VOC related problems, the propellant is desirably a gaseous, non-hydrocarbon propellant. According to the invention, it has been found that a non-hydrocarbon gaseous propellant that does not liquify when charged into aerosol container at a normal aerosol gas pressure of 140 psi at 130° F. can be used. The resulting packaged product dispenses the viscous vegetable oil or other product in fine droplets over the life of the aerosol packaged product. Desirably nitrogen, carbon dioxide, nitrous oxide, air, argon or other gaseous propellants may be used. There is no necessity that the propellant liquify in the aerosol container for it to effectively function in the invention. Preferably the propellant is added in an amount of from about 3 to 10% of viscous fluid e.g., vegetable oil containing composition with a maximum pressure of 140 psi at 130° F.

In operation the self contained closed pressurized container 10 delivers pressurized fluid preferably viscous vegetable oil e.g., a lecithin containing pan coating through delivery conduit 18 and then to nozzle assembly 30 which is snugly located in cavity 16. The fluid then travels from delivery conduit 18 through break up chamber 32 to first and second conduits 36 and 38, wherein the fluid velocity is increased. The fluid then travels through third and fourth conduits 40 and 42 where its velocity once again increases The fluid is dispensed through outlets 44 and 46. The discharge axis 50 of conduit 40 and discharge axis 52 of conduit 42 are oriented such that the pan coating exiting outlets 44 and 46 intersect at a point 48 outside the nozzle assembly. The intersection point 48 is preferably within one-half inch of outlets 44 and 46 most preferably within one-quarter of an inch of outlets 44 and 46. The speeding fluid preferably a pan coating from outlets 44 and 46 collides and is broken into small droplets to create a wide angled spray preferably in a generally rectangular pattern for coverage of the cooking area needing application.

The angle formed by the intersection of the discharge axises and shown in FIG. 2 as $\beta$ is referred to as the impingement angle. The third and fourth conduits 40 and 42 are oriented such that the discharge axis 50 and 52 form an impingement angle $\beta$ which is from 10° to 170°. Preferably the angle is from 40° to 140°, most preferably an impingement angle of about 40° to 70°; and desirably about 50°.

Desirably, the fluid is a vegetable oil and preferably a pan coating containing lecithin composition preferably from 1 to 15% lecithin and the remainder, vegetable oil. The pan coating most preferably is composed of 4 to 8% lecithin and the remaining vegetable oil. The vegetable oil component can be selected from a wide range of vegetable oils such as soybean oil, corn oil, safflower oil, sunflower oil, coconut oil, canola oil, olive oil, peanut oil; preferably a mixture of soybean oil and canola oil. Most preferably the pan coating composition is 87 parts by weight soybean oil, 6 parts by weight canola oil and 6 parts by weight lecithin and has a viscosity of about 81 cps at 66° F.

The foregoing is considered as illustrative only to the principles of the invention Further, since numerous changes and modifications will occur to those skilled in the art, it is not desired to limit the invention to the exact construction and operation shown and described above, and accordingly all suitable modifications and equivalents may be resorted to, falling within the scope of the invention.

We claim:

1. A dispensing system for viscous vegetable oil containing compositions comprising;

a viscous fluid vegetable oil containing composition having a viscosity greater than 60 cps;

a closed, self contained pressurized container for holding said fluid and delivering said fluid to a delivery passageway;

said container having a reservoir for holding said fluid for dispensing;

said delivery passageway having an outlet;

a nozzle assembly having an inlet end and an outlet end;

said nozzle assembly inlet interconnected with said outlet of said delivery passageway;

said nozzle assembly having a mechanical break up chamber at said nozzle assembly inlet for receipt of fluid from said delivery passageway;

a first and second passageway located in said nozzle assembly to split said fluid from said delivery passageway into two streams;

each said first and second passageway having a cross sectional area less than one half the cross sectional area of said mechanical break up chamber so that the velocity of said fluid increases in the first and second passageway from its velocity in said delivery passageway;

a first and second discharge means in fluid communication with said first and second passageway, said first discharge means having a first discharge axis to dispense the fluid from said nozzle assembly and said second discharge means having a second discharge axis to dispense fluid from said nozzle assembly;

said first and second discharge means including a first and second discharge outlet to separately direct the fluid flow from the first and second passageways beyond the nozzle assembly prior to the intersection of fluid flowing along the first and second discharge axis;

said first discharge axis and said second discharge axis intersecting at a collision point exterior to said nozzle assembly so that when said fluid is delivered from said reservoir and discharged to the atmosphere the fluid exiting from said first discharge means collides with the fluid exiting from said second discharge means to break the fluid into small droplets to form a wide angle mist for application to a surface.

2. The viscous fluid dispensing system of claim 1 further comprising:

a third and fourth passageway located in said nozzle assembly adjacent to and in fluid communication with said first and second passageway;

said third and fourth passageway having a smaller cross sectional area than that of said first and second passageway so that the velocity of the fluid increases from its velocity in said first and second passageway;

said third and fourth passageway located intermediate to said first and second passageway and said first and second discharge means.

3. The dispensing system for viscous fluids according to claim 1 wherein said first and second passageways are conduit means and said pressurized container is selected from the group consisting of pressurized bladder pack cans and pressured aerosol cans.

4. The dispensing system for viscous fluids according to claim 2 wherein said first, second, third and fourth passageways are conduit means and said pressurized container is selected from the group consisting of pressurized bladder pack cans and pressurized aerosol cans.

5. The dispensing system for viscous fluids according to claim 3 wherein the sum of the cross sectional areas of said first conduit and said second conduit is from ½ to 1/200 of the cross sectional area of said mechanical break up chamber.

6. The dispensing system according to claim 5 wherein the sum of the cross sectional areas of said first and second conduit is ¼ to 1/100 of the cross sectional area of said mechanical break up chamber.

7. The dispensing system according to claim 6 wherein the sum of the cross sectional areas of said first and second conduit is ¼ to about 1/50 of the cross sectional area of said mechanical break up chamber.

8. The dispensing system according to claim 4 wherein the cross sectional area of said third and fourth conduits is between ½ and 1/200 of the cross sectional area of said mechanical break up chamber.

9. The dispensing system for viscous fluids according to claim 8 wherein said first and second conduits are the same size and the sum of cross sectional areas of said first conduit and said second conduit is about one-quarter of the cross sectional area of said mechanical break up chamber.

10. The dispensing system according to claim 6 wherein the cross sectional area of said third conduit is about one-twelfth the cross sectional area of said first conduit and the cross sectional area of said fourth conduit is about one-twelfth of the cross sectional area of the second conduit.

11. The dispensing system for viscous fluids according to claim 1 wherein said collision point is located less than one-half inch from said first and second discharge means.

12. The dispensing system for viscous fluids according to claim 1 wherein said collision point is located about one-quarter inch from said discharge means.

13. The dispensing system for viscous fluids according to claim 2 wherein said collision point is located less than one-half inch from said first and second discharge means.

14. The dispensing system for viscous fluids according to claim 2 wherein said collision point is located less than one quarter from said first and second discharge means.

15. The dispensing system for viscous fluids according to claim 1 further comprising an annular collar located on said nozzle assembly to hold said nozzle assembly in fluid communication with said delivery passageway.

16. The viscous fluids dispensing according to claim 2 further comprising:

a first projection and a second projection located on the outlet end of said nozzle assembly;

a v-shaped notch separating said first and second projections;

said first and second discharge means located on opposite side walls of said v-shaped notch.

17. The viscous fluids dispensing system according to claim 15 further comprising a first projection and a second projection located on the outlet end of said nozzle assembly;

a v-shaped notch separating said first and second projections;

said first and second discharge means located on opposite side walls of said v-shaped notch.

18. The dispensing system according to claim 1 wherein the impingement angle C is from 40° to 140°.

19. The system according to claim 3 wherein the closed pressurized system is an aerosol can having a suitable aerosol propellant.

20. The system according to claim 19 wherein said propellant is a non-hydrocarbon, gaseous propellant.

21. The system according to claim 20 wherein said propellant is selected from the group, air, nitrogen, carbon dioxide, nitrous oxide and argon.

22. The system according to claim 21 wherein the propellant is nitrous oxide

23. The system according to claim 21 wherein the propellant is air.

24. The system according to claim 4 wherein the closed pressurized system is an aerosol can having a suitable aerosol propellant.

25. The system according to claim 24 wherein said propellant is a non-hydrocarbon, gaseous propellant.

26. The system according to claim 25 wherein said propellant is selected from the group, air, nitrogen, carbon dioxide, nitrous oxide and argon.

27. A self contained, closed pressurized container for the delivery of a pressurized fluid comprising:

a delivery passageway for the transfer of pressurized fluid from said container;

a nozzle assembly having an inlet end and an outlet end;

said nozzle assembly inlet interconnected with said outlet of said delivery passageway;

said nozzle assembly having a mechanical break up chamber at said nozzle assembly inlet for receipt of fluid from said delivery passageway;

a first and second passageway located in said nozzle assembly to split the fluid from said mechanical break up chamber into two streams;

each said first and second passageway having a cross sectional area less than one half the cross sectional of the mechanical break up chamber so that the velocity of said fluid increases in the first and second passageway from its velocity in said mechanical break up chamber;

a first and second discharge means in fluid communication with said first and second passageway, said first discharge means having a first discharge axis to dispense the fluid from said nozzle assembly and said second discharge means having a second discharge axis to dispense fluid from said nozzle assembly;

said first and second discharge means including a first and second discharge outlet to separately direct the fluid flow from the first and second passageways beyond the nozzle assembly prior to the intersection of fluid flowing along the first and second discharge axis;

said first discharge axis and said second discharge axis intersecting at a collision point exterior to said nozzle assembly so that when said fluid is delivered from said reservoir and discharged to the atmosphere the fluid exiting from said first discharge means collides with the fluid exiting from said second discharge means to break the fluid into small droplets to form a wide angle mist for application to a surface.

28. A closed self contained pressurized container according to claim 27 further comprising:

a third and fourth passageway located in said nozzle assembly adjacent to and in fluid communication with said first and second passageway;

the cross sectional areas of said third and fourth passageway being smaller than that of said first and second passageway so that the velocity of the fluid increases from its velocity in said first and second passageway;

said third and fourth passageway located intermediate to said first and second passageway and said first and second discharge means.

29. The closed, self contained pressurized container according to claim 27 wherein said first and second passageway are conduit means.

30. The closed, self contained pressurized container according to claim 28 wherein said first, second, third and fourth passageways are conduit means.

31. The closed self contained pressurized container according to claim 30 wherein the sum of cross sectional areas of said first conduit and said second conduit is from ½ to 1/200 of the cross sectional area of said mechanical break up chamber.

32. The closed, self contained pressurized container according to claim 31 wherein the sum of the cross sectional areas of said first and second conduit is ¼ to 1/100 of the cross sectional area of said mechanical break up chamber.

33. The closed, self contained pressurized container according to claim 32 wherein the sum of the cross sectional areas of said first and second conduits is ¼ to about 1/50 of the cross sectional area of said mechanical break up chamber.

34. The closed, self contained pressurized container according to claim 30 wherein the cross sectional areas of said third and fourth conduits is between ½ and 1/200 of the cross sectional area of said mechanical break up chamber.

35. The closed, self contained pressurized container according to claim 34 wherein the first and second conduits are the same size and the cross sectional area of said first and second conduits is about one-quarter of the cross sectional area of the mechanical break up chamber.

36. The closed, self contained pressurized container according to claim 35 wherein said first and second conduits are the same size and the cross sectional area of said third conduit is about one-twelfth the cross sectional area of said first conduit and the cross sectional area of said fourth conduit is about onetwelfth of the cross sectional area of the second conduit.

37. The closed, self contained pressurized container according to claim 27 further comprising:

a first projection and a second projection located on the outlet end of said nozzle assembly;

a v-shaped notch separating said first and second projections;

said first and second discharge means located on opposite side walls of said v-shaped notch.

38. The closed, pressurized container according to claim 27 wherein the impingement angle $\beta$ is from 40° to 140°.

39. The container of claim 27 wherein said pressurized container is selected from the group consisting of pressurized bladder cans and pressurized aerosol cans.

40. The container of claim 39 wherein said pressurized container is an aerosol can containing a suitable aerosol propellant.

41. The container of claim 40 wherein said aerosol propellant is a non-hydrocarbon gaseous propellant.

42. The container of claim 41 wherein said aerosol propellant is selected from the group of air, nitrogen, carbon dioxide, nitrous oxide and argon.

43. The container of claim 42 wherein the aerosol propellant is nitrous oxide.

44. The container of claim 43 wherein the aerosol propellant is air.

45. The container of claim 28 wherein said pressurized container is selected from the group consisting of pressurized bladder cans and pressurized aerosol cans.

46. The container of claim 45 wherein said pressurized container is an aerosol can containing a suitable aerosol propellant.

47. The container of claim 46 wherein said aerosol propellant is a non-hydrocarbon gaseous propellant.

48. The container of claim 47 wherein said aerosol propellant is selected from the group of air, nitrogen, carbon dioxide, nitrous oxide and argon.

49. The container of claim 48 wherein the aerosol propellant is nitrous oxide.

50. The container of claim 48 wherein the aerosol propellant is air.

* * * * *